US006390774B1

(12) United States Patent
Lewis et al.

(10) Patent No.: US 6,390,774 B1
(45) Date of Patent: May 21, 2002

(54) GAS TURBINE BUCKET COOLING CIRCUIT AND RELATED PROCESS

(75) Inventors: Doyle C. Lewis, Greer, SC (US); Kevin Joseph Barb, Halfmoon, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/496,715

(22) Filed: Feb. 2, 2000

(51) Int. Cl.[7] ..... F01D 5/08
(52) U.S. Cl. ..... 416/96 R
(58) Field of Search ..... 415/115; 416/96 R

(56) References Cited

U.S. PATENT DOCUMENTS

| | | | | |
|---|---|---|---|---|
| 4,212,587 A | * | 7/1980 | Horner | 416/96 R |
| 4,242,045 A | * | 12/1980 | Grondahl et al. | 416/92 |
| 4,244,676 A | * | 1/1981 | Grondahl et al. | 416/92 |
| 5,491,971 A | | 2/1996 | Tomlinson et al. | |
| 5,536,143 A | | 7/1996 | Jacala et al. | |
| 5,591,002 A | | 1/1997 | Cunha et al. | |
| 5,823,741 A | | 10/1998 | Predmore et al. | |
| 6,065,931 A | * | 5/2000 | Suenaga et al. | 416/97 R |
| 6,092,991 A | * | 7/2000 | Tomita et al. | 416/96 R |

FOREIGN PATENT DOCUMENTS

JP 409280002 A * 10/1997

OTHER PUBLICATIONS

"39$^{th}$ GE Turbine State–of–the–Art Technology Seminar", Tab 1, ""F" Technology—the First Half–Million Operating Hours", H.E. Miller, Aug. 1996.
"39th GE Turbine State–of–the–Art Technology Seminar", Tab 2, "GE Heavy–Duty Gas Turbine Performance Characteristics", F. J. Brooks, Aug. 1996.
"39th GE Turbine State–of–the–Art Technology Seminar", Tab 3, "9EC 50Hz 170–MW Class Gas Turbine", A. S. Arrao, Aug. 1996.
"39th GE Turbine State–of–the–Art Technology Seminar", Tab 4, "MWS6001FA—An Advanced–Technology 70–MW Hz Gas Turbine", Ramachandran et al., Aug. 1996.
"39th GE Turbine State–of–the–Art Technology Seminar", Tab 5, "Turbomachinery Technology Advances at Nuovo Pignone", Benvenuti et al., Aug. 1996.

(List continued on next page.)

*Primary Examiner*—Edward K. Look
*Assistant Examiner*—Ninh Nguyen
(74) *Attorney, Agent, or Firm*—Nixon & Vanderhye P.C.

(57) ABSTRACT

A turbine bucket includes an airfoil portion having leading and trailing edges; at least one radially extending cooling passage within the airfoil portion, the airfoil portion joined to a platform at a radially inner end of the airfoil portion; a dovetail mounting portion enclosing a cooling medium supply passage; and, a crossover passage in fluid communication with the cooling medium supply passage and with at least one radially extending cooling passage, the crossover passage having a portion extending along and substantially parallel to an underside surface of the platform.

15 Claims, 6 Drawing Sheets

OTHER PUBLICATIONS

"39th GE Turbine State–of–the–Art Technology Seminar", Tab 6, "GE Aeroderivative Gas Turbines—Design and Operating Features", M.W. Horner, Aug. 1996.
"39th GE Turbine State–of–the–Art Technology Seminar", Tab 7, "Advance Gas Turbine Materials and Coatings", P.W. Schilke, Aug. 1996.
"39th GE Turbine State–of–the–Art Technology Seminar", Tab 8, "Dry Low $NO_x$ Combustion Systems for GE Heavy–Duty Turbines", L. B. Davis, Aug. 1996.
"39th GE Turbine State–of–the–Art Technology Seminar", Tab 9, "GE Gas Turbine Combustion Flexibility", M. A. Davi, Aug. 1996.
"39th GE Turbine State–of–the–Art Technology Seminar", Tab 10, "Gas Fuel Clean–Up System Design Considerations for GE Heavy–Duty Gas Turbines", C. Wilkes, Aug. 1996.
"39th GE Turbine State–of–the–Art Technology Seminar", Tab 11, "Integrated Control Systems for Advanced Combined Cycles", Chu et al., Aug. 1996.
"39th GE Turbine State–of–the–Art Technology Seminar", Tab 12, "Power Systems for the 21st Century "H" Gas Turbine Combined Cycles", Paul et al., Aug. 1996.
"39th GE Turbine State–of–the–Art Technology Seminar", Tab 13, "Clean Coal and Heavy Oil Technologies for Gas Turbines", D. M. Todd, Aug. 1996.
"39th GE Turbine State–of–the–Art Technology Seminar", Tab 14, "Gas Turbine Conversions, Modifications and Uprates Technology", Stuck et al., Aug. 1996.
"39th GE Turbine State–of–the–Art Technology Seminar", Tab 15, "Performance and Reliability Improvements for Heavy–Duty Gas Turbines, "J. R. Johnston, Aug. 1996.
"39th GE Turbine State–of–the–Art Technology Seminar", Tab 16, "Gas Turbine Repair Technology", Crimi et al, Aug. 1996.
"39th GE Turbine State–of–the–Art Technology Seminar", Tab 17, "Heavy Duty Turbine Operating & Maintenance Considerations", R. F. Hoeft, Aug. 1996.
"39th GE Turbine State–of–the–Art Technology Seminar", Tab 18, "Gas Turbine Performance Monitoring and Testing", Schmitt et al., Aug. 1996.
"39th GE Turbine State–of–the–Art Technology Seminar", Tab 19, "Monitoring Service Delivery System and Diagnostics", Madej et al., Aug. 1996.
"39th GE Turbine State–of–the–Art Technology Seminar", Tab 20, "Steam Turbines for Large Power Applications", Reinker et al., Aug. 1996.
"39th GE Turbine State–of–the–Art Technology Seminar", Tab 21, "Steam Turbines for Ultrasupercritical Power Plants", Retzlaff et al., Aug. 1996.
"39th GE Turbine State–of–the–Art Technology Seminar", Tab 22, "Steam Turbine Sustained Efficeincy", P. Schofield, Aug. 1996.
"39th GE Turbine State–of–the–Art Technology Seminar", Tab 23, "Recent Advances in Steam Turbines for Industrial and Cogenaration Applications", Leger et al., Aug. 1996.
"39th GE Turbine State–of–the–Art Technology Seminar", Tab 24, "Mechanical Drive Steam Turbines", D. R. Leger, Aug. 1996.
"39th GE Turbine State–of–the–Art Technology Seminar", Tab 25, "Steam Turbines for STAG™ Combined–Cycle Power Systems", M. Boss, Aug. 1996.
"39th GE Turbine State–of–the–Art Technology Seminar", Tab 26, "Cogeneration Application Considerations", Fisk et al., Aug. 1996.
"39th GE Turbine State–of–the–Art Technology Seminar", Tab 27, "Performance and Economic Considerations of Repowering Steam Power Plants", Stoll et al., Aug. 1996.
"39th GE Turbine State–of–the–Art Technology Seminar", Tab 28, "High–Power–Density™ Steam Turbine Design Evolution", J. H. Moore, Aug. 1996.
"39th GE Turbine State–of–the–Art Technology Seminar", Tab 29, "Advances in Steam Path Technologies", Cofer, IV, et al., Aug. 1996.
"39th GE Turbine State–of–the–Art Technology Seminar", Tab 30, "Upgradable Opportunities for Steam Turbines", D. R. Dreier, Jr., Aug. 1996.
"39th GE Turbine State–of–the–Art Technology Seminar", Tab 31, "Uprate Options for Industrial Turbines", R. C. Beck, Aug. 1996.
"39th GE Turbine State–of–the–Art Technology Seminar", Tab 32, "Thermal Performance Evaluation and Assessment of Steam Turbine Units", P. Albert, Aug. 1996.
"39th GE Turbine State–of–the–Art Technology Seminar", Tab 33, "Advances in Welding Repair Technology" J. F. Nolan, Aug. 1996.
"39th GE Turbine State–of–the–Art Technology Seminar", Tab 34, "Operation and Maintenance Strategies to Enhance Plant Profitability", MacGillivray et al., Aug. 1996.
"39th GE Turbine State–of–the–Art Technology Seminar", Tab 35, "Generator Insitu Inspections", D. Stanton.
"39th GE Turbine State–of–the–Art Technology Seminar", Tab 36, "Generator Upgrade and Rewind", Halpern et al., Aug. 1996.
"39th GE Turbine State–of–the–Art Technology Seminar", Tab 37, "GE Combined Cycle Product Line and Performance", Chase, et al., Aug. 1996.
"39th GE Turbine State–of–the–Art Technology Seminar", Tab 38, "GE Combined Cycle Experience", Maslak et al., Aug. 1996.
"39th GE Turbine State–of–the–Art Technology Seminar", Tab 39, "Single–Shaft Combined Cycle Power Generation Systems", Tomlinson et al., Aug. 1996.
"Advanced Turbine System Program—Conceptual Design and Product Development", Annual Report, Sep. 1, 1994–Aug. 31, 1995.
"Advances Turbine Systems (ATS Program) Conceptual Design and Product Development", Final Technical Progress Report, vol. 2– Industrial Machine, Mar. 31, 1997, Morgantown, WV.
"Advanced Turbine Systems (ATS Program), Conceptual Design and Product Development", FInal Technical Progress Report, Aug. 31, 1996, Morgantown, WV.
"Advanced Turbine Systems (ATS) Program, Phase 2, Conceptual Design and Product Development", Yearly Technical Progress Report, Reporting Period: Aug. 25, 1993–Aug. 31, 1994.
"Advanced Turbine Systems" Annual Program Review, Preprints, Nov. 2–4, 1998, Washington, D.C. U.S. Department of Energy, Office of Industrial Technologies Federal Energy Technology Center.
"ATS Conference" Oct. 28, 1999, Slide Presentation.
"Baglan Bay Launch Site", various articles relating to Baglan Energy Park.
"Baglan Energy Park", Brochure.
"Commercialization", Del Williamson, Present, Global Sales, May 8, 1998.

"Environmental, Health and Safety Assessment: ATS 7H Program (Phase 3R) Test Activities at the GE Power Systems Gas Turbine Manufacturing Facility, Greenville, SC", Document #1753, Feb. 1998, Publication Date: Nov. 17, 1998, Report Nos. DE–FC21–95MC31176–11.
"Exhibit panels used at 1995 product introduction at PowerGen Europe".
"Extensive Testing Program Validates High Efficiency, reliability of GE's Advanced "H" Gas Turbine Technology", Press Information, Press Release, 96–NR14, Jun. 26, 1996, H Technology Tests/pp. 1–4.
"Extensive Testing Program Validates High Efficiency, Reliability of GE's Advanced "H" Gas Turbine Technology", GE Introduces Advanced Gas Turbine Technology Platform: First to Reach 60% Combined–Cycle Power Plant Efficiency, Press Information, Press Release, Power–Gen Europe '95, 95–NRR15, Advanced Technology Introduction/pp. 1–6.
"Gas, Steam Turbine Work as Single Unit in GE's Advanced H Technology Combined–Cycle System", Press Information, Press Release, 95–NR18, May 16, 1995, Advanced Technology Introduction/pp. 1–3.
"GE Breaks 60% Net Efficiency Barrier" paper, 4 pages.
"GE Businesses Share Technologies and Experts to Develop State–Of–The–Art Products", Press Information, Press Release 95–NR10, May 16, 1995, GE Technology Transfer/pp. 1–3.
"General Electri ATS Program Technical Review, Phase 2 Activities", T. Chance et al., pp. 1–4.
"General Electric's DOE/ATS H Gas Turbine Development" Advanced Turbine Systems Annual Review Meeting, Nov. 7–8, 1996, Washington, D.C., Publication Release.
"H Technology Commercialization", 1998 MarComm Activity Recommendation, Mar., 1998.
"H Technology", Jon Ebacher, VP, Power Gen Technology, May 8, 1998.
"H Testing Process", Jon Ebacher, VP, Power Gen Technology, May 8, 1998.
"Heavy–Duty & Aeroderivative Products" Gas Turbines, Brochure, 1998.
"MS7001H/MS9001H Gas Turbine, gepower.com website for PowerGen Europe" Jun. 1–3 going public Jun. 15, (1995).
"New Steam Cooling System is a Key to 60% Efficiency For GE "H" Technology Combined–Cycle Systems", Press Information, Press Release, 95–NRR16, May 16, 1995, H Technology/pp. 1–3.
"Overview of GE's H Gas Turbine Combined Cycle", Jul. 1, 1995 to Dec. 31, 1997.
"Power Systems for the 21st Century—"H" Gas Turbine Combined Cycles", Thomas C. Paul et al., Report.
"Power–Gen '96 Europe", Conference Programme, Budapest, Hungary, Jun. 26–28, 1996.
"Power–Gen International", 1998 Show Guide, Dec. 9–11, 1998, Orange County Convention Center, Orlando, Florida.
"Press Coverage following 1995 product announcement"; various newpaper clippings relating to improved generator.
"Proceedings of the Advanced Turbine Systems Annual Program Review Meeting", vol. 1, "Industrial Advanced Turbine Systems Program Overview", D.W. Esbeck, p. 3–13, Oct., 1995.
"Proceedings of the Advanced Turbine Systems Annual Program Review Meeting", vol. I, "H Gas Turbine Combined Cycle", J. Corman, p. 14–21, Oct., 1995.
"Proceedings of the Advanced Turbine Systems Annual Program Review Meeting", vol. I, "Overview of Westinghouse's Advanced Turbine Systems Program", Bannister et al., p. 22–30, Oct., 1995.
"Proceedings of the Advanced Turbine Systems Annual Program Review Meeting", vol. I, "Allison Engine ATS Program Technical Review", D. Mukavetz, p. 31–42, Oct., 1995.
"Proceedings of the Advanced Turbine Systems Annual Program Review Meeting", vol. I, "Advanced Turbine Systems Program Industrial System Concept Development", S. Gates, p. 43–63, Oct., 1995.
"Proceedings of the Advanced Turbine Systems Annual Program Review Meeting", vol. I, "Advanced Turbine System Program Phase 2 Cycle Selection", Latcovich, Jr., p. 64–69, Oct., 1995.
"Proceedings of the Advanced Turbine Systems Annual Program Review Meeting", vol. I, "General Electric ATS Program Technical Review Phase 2 Activities", Chance et al., p. 70–74, Oct., 1995.
"Proceedings of the Advanced Turbine Systems Annual Program Review Meeting", vol. I, "Technical Review of Westinghouse's Advanced Turbine Systems Program", Diakunchak et al., p. 75–86, Oct., 1995.
"Proceedings of the Advanced Turbine Systems Annual Program Review Meeting", vol. I, "Advanced Combustion Turbines and Cycles: An EPRI Perspective", Touchton et al., p. 87–88, Oct., 1995.
"Proceedings of the Advanced Turbine Systems Annual Program Review Meeting", vol. I, "Advanced Turbine Systems Annual Program Review", William E. Koop, p. 89–92, Oct., 1995.
"Proceedings of the Advanced Turbine Systems Annual Program Review Meeting", vol. I, "The AGTSR Consortium: An Update", Fant et al., p. 93–102, Oct., 1995.
"Proceedings of the Advanced Turbine Systems Annual Program Review Meeting", vol. I, "Overview of Allison/AGTSR Interactions", Sy A. Ali, p. 103–106, Oct., 1995.
"Proceedings of the Advanced Turbine Systems Annual Program Review Meeting", vol. I, "Design Factors for Stable Lean Premix Combustion", Richards et al., p. 107–113, Oct., 1995.
"Proceedings of the Advanced Turbine Systems Annual Program Review Meeting", vol. I, "Ceramic Stationary as Turbine", M. van Roode, p. 114–147, Oct., 1995.
"Proceedings of the Advanced Turbine Systems Annual Program Review Meeting", vol. I, "DOE/Allison Ceramic Vane Effort", Wenglarz et al., p. 148–151, Oct., 1995.
"Proceedings of the Advanced Turbine Systems Annual Program Review Meeting", vol. I, "Materials/Manufacturing Element of the Advanced Turbine Systems Program", Karnitz et al., p. 152–160, Oct., 1995.
"Proceedings of the Advanced Turbine Systems Annual Program Review Meeting", vol. I, "Land–Based Turbine Casting Initiative", Mueller et al., p. 161–170, Oct., 1995.
"Proceedings of the Advanced Turbine Systems Annual Program Review Meeting", vol. I, "Turbine Airfoil Manufacturing Technology", Kortovich, p. 171–181, Oct., 1995.
"Proceedings of the Advanced Turbine Systems Annual Program Review Meeting", vol. I, "Pratt & Whitney Thermal Barrier Coatings", Bornstein et al., p. 182–193, Oct., 1995.

"Proceedings of the Advanced Turbine Systems Annual Program Review Meeting", vol. I, "Westinhouse Thermal Barrier Coatings", Goedjen et al., p. 194–199, Oct., 1995.

"Proceedings of the Advanced Turbine Systems Annual Program Review Meeting", vol. I, "High Performance Steam Development", Duffy et al., p. 200–220, Oct., 1995.

"Proceedings of the Advanced Turbine Systems Annual Program Review Meeting", vol. II, "Lean Preamixed Combustion Stabilized by Radiation Feedback and heterogenous Catalysis", Dibble et al., p. 221–232, Oct., 1995.

"Proceedings of the Advanced Turbine Systems Annual Program Review Meeting", vol. II, Rayleigh/Raman/LIF Measurements in a Turbulent Lean Premixed Combustor, Nandula et al. p. 233–248, Oct., 1995.

"Proceedings of the Advanced Turbine Systems Annual Program Review Meeting", vol. II, "Lean Premixed Flames for Low $No_x$ Combustors", Sojka et al., p. 249–275, Oct., 1995.

"Proceedings of the Advanced Turbine Systems Annual Program Review Meeting", vol. II, "Functionally Gradient Materials for Thermal Barrier Coatings in Advanced Gas Turbine Systems", Banovic et al., p. 276–280, Oct., 1995.

"Proceedings of the Advanced Turbine Systems Annual Program Review Meeting", vol. II, "Advanced Turbine Cooling, Heat Transfer, and Aerodynamic Studies", Han et al., p. 281–309, Oct., 1995.

"Proceedings of the Advanced Turbine Systems Annual Program Review Meeting", vol. II, "Life Prediction of Advanced Materials for Gas Turbine Application", Zamrik et al., p. 310–327, Oct., 1995.

"Proceedings of the Advanced Turbine Systems Annual Program Review Meeting", vol. II, "Advanced Combustion Technologies for Gas Turbine Power Plants", Vandsburger et al., p. 328–352, Oct., 1995.

"Proceedings of the Advanced Turbine Systems Annual Program Review Meeting", vol. II, "Combustion Modeling in Advanced Gas Turbine Systems", Smoot et al., p. 353–370, Oct., 1995.

"Proceedings of the Advanced Turbine Systems Annual Program in Review Meeting", vol. II, "Heat Transfer in a Two–Pass Internally Ribbed Turbine Blade Coolant Channel with Cylindrical Vortex Generators", Hibbs et al. p. 371–390, Oct., 1995.

"Proceedings of the Advanced Turbine Systems Annual Program Review Meeting", vol. II, "Rotational Effects on Turbine Blade Cooling", Govatzidakia et al., p. 391–392, Oct., 1995.

"Proceedings of the Advanced Turbine Systems Annual Program Review Meeting", vol. II, "Manifold Methods for Methane Combustion", Yang et al., p. 393–409, Oct., 1995.

"Proceedings of the Advanced Turbine Systems Annual Program Review Meeting", vol. II, "Advanced Multistage Turbine Blade Aerodynamics, Performance, Cooling, and Heat Transfer", Fleeter et al., p. 410–414, Oct., 1995.

"Proceedings of the Advanced Turbine Systems Annual Program Review Meeting, vol. II", The Role of Reactant Unmixedness, Strain Rate, and Length Scale on Premixed Combustor Performance, Samuelsen et al., p. 415–422, Oct., 1995.

"Proceedings of the Advanced Turbine Systems Annual Program Review Meeting", vol. II, "Experimental and Computational Studies of Film Cooling With Compound Angle Injection", Goldstein et al., p. 423–451, Oct., 1995.

"Proceedings of the Advanced Turbine Systems Annual Program Review Meeting", vol. II, "Compatibility of Gas Turbine Materials with Steam Cooling", Desai et al., p. 452–464, Oct., 1995.

"Proceedings of the Advanced Turbine Systems Annual Program Review Meeting", vol II, "Use of a Laser–Induced Fluorescence Thermal Imaging System for Film Cooling Heat Transfer Measurement", M. K. Chyu, p. 465–473, Oct., 1995.

"Proceedings of the Advanced Turbine Systems Annual Program Review Meeting", vol. II, Effects of Geometry on Slot–Jet Film Cooling Performance, Hyams et al., p. 474–496 Oct., 1995.

"Proceedings of the Advanced Turbine Systems Annual Program Review Meeting", vol. II, "Steam as Turbine Blade Coolant: Experimental Data Generation", Wilmsen et al., p. 497–505, Oct., 1995.

"Proceedings of the Advanced Turbine Systems Annual Program Review Meeting", vol. II, "Combustion Chemical Vapor Deposited Coatings for Thermal Barrier Coating Systems", Hampikian et al., p. 506–515, Oct., 1995.

"Proceedings of the Advanced Turbine Systems Annual Program Review Meeting", vol. II, "Premixed Burner Experiments: Geometry, Mixing, and Flame Structure Issues", Gupta et al., p. 516–528, Oct., 1995.

"Proceedings of the Advanced Turbine Systems Annual Program Review Meeting", vol. II, "Intercooler Flow Path for Gas Turbines: CFD Design and Experiments", Agrawal et al., p. 529–538, Oct., 1995.

"Proceedings of the Advanced Turbine Systems Annual Program Review Meeting", vol. II, "Bond Strength and Stress Measurements in Thermal Barrier Coatings", Gell et al., p. 539–549, Oct., 1995.

"Proceedings of the Advanced Turbine Systems Annual Program Review Meeting", vol. II, "Active Control of Combustion Instabilities in Low $NO_x$ Gas Turbines", Zinn et al., p. 550–551, Oct., 1995.

"Proceedings of the Advanced Turbine Systems Annual Program Review Meeting", vol. II, "Combustion Instability Modeling and Analysis", Santoro et al., p. 552–559, Oct., 1995.

"Proceedings of the Advanced Turbine Systems Annual Program Review Meeting", vol. II, "Flow and Heat Transfer in Gas Turbine Disk Cavities Subject to Nonuniform External Pressure Field", Roy et al., p. 560–565, Oct., 1995.

"Proceedings of the Advanced Turbine Systems Annual Program Review Meeting", vol. II, "Heat Pipe Turbine Vane Cooling", Langston et al., p. 566–572, Oct., 1995.

"Proceedings of the Advanced Turbine Systems Annual Program Review Meeting", vol. II, "Improved Modeling Techniques for Turbomachinery Flow Fields", Lakshminarayana et al., p. 573–581, Oct., 1995.

"Proceedings of the Advanced Turbine Systems Annual Program Review Meeting", vol. II, "Advanced 3D Inverse Method for Designing Turbomachine Blades", T. Dang, p. 582, Oct., 1995.

"Proceedings of the Advanced Turbine Systems Annual Program Review Meeting", "ATS and the Industries of the Future", Denise Swink, p. 1, Nov., 1996.

"Proceedings of the Advanced Turbine Systems Annual Program Review Meeting", "Gas Turbine Association Agenda", William H. Day, p. 3–16, Nov. 1996.

"Proceedings of the Advanced Turbine Systems Annual Program Review Meeting", "Power Needs in the Chemical Industry", Keith Davidson, p. 17–26, Nov., 1996.

"Proceedings of the Advanced Turbine Systems Annual Program Review Meeting", "Advanced Turbine Systems Program Overview", David Esbeck, p. 27–34, Nov., 1996.

"Proceedings of the Advanced Turbine Systems Annual Program Review Meeting", "Westinghouse's Advanced Turbine Systems Program", Gerard McQuiggan, p. 35–48, Nov., 1996.

"Proceedings of the Advanced Turbine Systems Annual Program Review Meeting", "Overview of GE's H Gas Turbine Combined Cycle", Cook et al., p. 49–72, Nov., 1996.

"Proceedings of the Advanced Turbine Systems Annual Program Review Meeting", "Allison Advanced Simple Cycle Gas Turbine System", William D. Weisbrod, p. 73–94, Nov., 1996.

"Proceedings of the Advanced Turbine Systems Annual Program Review Meeting", "The AGTSR Industry—University Consortium", Lawrence P. Golan, p. 95–110, Nov., 1996.

"Proceedings of the Advanced Turbine Systems Annual Program Review Meeting", "$NO_x$ and CO Emissions Models for Gas–Fired Lean–Premixed Combustion Turbines", A. Mellor, p. 111–112, Nov., 1996.

"Proceedings of the Advanced Turbine Systems Annaul Program Review Meeting", "Methodologies for Active Mixing and Combustion Control", Uri Vandsburger, p. 123–156, Nov., 1996.

"Proceedings of the Advanced Turbine Systems Annual Program Review Meeting", "Combustion Modeling in Advanced Gas Turbine Systems", Paul O. Hedman, p. 157–180, Nov., 19967.

"Proceedings of the Advanced Turbine Systems Annual Program Review Meeting", "Manifold Methods for Methane Combustion", Stephen B. Pope, p. 181–188, Nov., 1996.

"Proceedings of the Advanced Turbine Systems Annual Program Review Meeting", "The Role of Reactant Unmixedness, Strain Rate, and Length Scale on Premixed Combustor Performance", Scott Samuelsen, p. 189–210, Nov., 1996.

"Proceedings of the Advanced Turbine Systems Annual Program Review Meeting", "Effect of Swirl and Momentum Distribution on Temperature Distribution in Premixed Flames", Ashwani K. Gupta, p. 211–232, Nov., 1996.

"Proceedings of the Advanced Turbine Systems Annual Program Review Meeting", "Combustion Instability Studies Application to Land–Based Gas Turbine Combustors", Robert J. Santoro, p. 233–252.

"Proceedings of the Advanced Turbine Systems Annual Program Review Meeting", Active Control of Combustion Instabilities in Low $NO_x$ Turbines, Ben T. Zinn, p. 253–264, Nov., 1996.

"Proceedings of the Advanced Turbine Systems Annual Program Review Meeting", "Life Prediction of Advanced Materials for Gas Turbine Application," Sam Y. Zamrik, p. 265–274, Nov., 1996.

"Proceedings of the Advanced Turbine Systems Annual Program Review Meeting", "Combustion Chemical Vapor Deposited Coatings for Thermal Barrier Coating Systems", W. Brent Carter, p. 275–290, Nov., 1996.

"Proceedings of the Advanced Turbine Systems Annual Program Review Meeting", "Compatibility of Gas Turbine Materials with Steam Cooling", Vimal Desai, p. 291–314, Nov., 1996.

"Proceedings of the Advanced Turbine Systems Annual Program Review Meeting", "Bond Strength and Stress Measurements in Thermal Barrier Coatings", Maurice Gell, p. 315–334, Nov., 1996.

"Proceedings of the Advanced Turbine Systems Annual Program Review Meeting", "Advanced Multistage Turbine Blade Aerodynamics, Performance, Cooling and Heat Transfer", Sanford Fleeter, p. 335–356, Nov., 1996.

"Proceedings of the Advanced Turbine Systems Annual Program Review Meeting", "Flow Characteristics of an Intercooler System for Power Generating Gas Turbines", Ajay K. Agrawal, p. 357–370, Nov., 1996.

"Proceedings of the Advanced Turbine Systems Annual Program Review Meeting", "Improved Modeling Techniques for Turbomachinery Flow Fields", B. Lakshiminaryana, p. 371–392, Nov., 1996.

"Proceedings of the Advanced Turbine Systems Annual Program Review Meeting", "Development of an Advanced 3d & Viscous Aerodynamic Design Method for Turbomachine Components in Utility and Industrial Gas Turbine Applications", Thong Q. Dang, p. 393–406, Nov., 1996.

"Proceedings of the Advanced Turbine Systems Annual Program Review Meeting", "Advanced Turbine Cooling, Heat Transfer, and Aerodynamic Studies", Je–Chin Han, p. 407–426, Nov., 1996.

"Proceedings of the Advanced Turbine Systems Annual Program Review Meeting", "Heat Transfer in a Two–Pass Internally Ribbed Turbine Blade Coolant Channel with Vortex Generators", S. Acharya, p. 427–446.

"Proceedings of the Advanced Turbine Systems Annual Program Review Meeting", "Experimental and Computational Studies of Film Cooling with Compound Angle Injection", R. Goldstein, p. 447–460, Nov., 1996.

"Proceedings of the Advanced Turbine Systems Annual Program Review Meeting", "Study of Endwall Film Cooling with a Gap Leakage Using a Thermographic Phosphor Fluorescence Imaging System", Minking K. Chyu, p. 461–470, Nov., 1996.

"Proceedings of the Advanced Turbine Systems Annual Program Review Meeting", "Steam as a Turbine Blade Coolant: External Side Heat Transfer", Abraham Engeda, p. 471–482, Nov., 1996.

"Proceedings of the Advanced Turbine Systems Annual Program Review Meeting", "Flow and Heat Transfer in Gas Turbine Disk Cavities Subject to Nonuniform External Pressure Field", Ramendra Roy, p. 483–498, Nov., 1996.

"Proceedings of the Advanced Turbine Systems Annual Program Review Meeting", "Closed–Loop Mist/Steam Cooling for Advanced Turbine Systems", Tin Wang, p. 499–512, Nov., 1996.

"Proceedings of the Advanced Turbine Systems Annual Program Review Meeting", "Heat Pipe Turbine Vane Cooling", Langston et al., p. 513–534, Nov., 1996.

"Proceedings of the Advanced Turbine Systems Annual Program Review Meeting", "EPRI's Combustion Turbine Program: Status and Future Directions", Arthur Cohn, p. 535–553 Nov., 1996.

"Proceedings of the Advanced Turbine Systems Annual Program Review Meeting", "ATS Materials Support", Michael Karnitz, p. 553–576, Nov., 1996.

"Proceedings of the Advanced Turbine Systems Annual Program Review Meeting", "Land Based Turbine Casting Initiative", Boyd A. Mueller, p. 577–592, Nov., 1996.
"Proceedings of the Advanced Turbine Systems Annual Program Review Meeting", "Turbine Airfoil Manufacturing Technology", Charles S. Kortovich, p. 593–622, Nov., 1996.
"Proceedings of the Advanced Turbine Systems Annual Program Review Meeting", "Hot Corrosion Testing of TBS's", Norman Bornstein, p. 623–631, Nov., 1996.
"Proceedings of the Advanced Turbine Steam Annual Program Review Meeting", "Ceramic Stationary Gas Turbine", Mark van Roode, p. 633–658, Nov., 1996.
"Proceedings of the Advanced Turbine Systems Annual Program Review Meeting", "Western European Status of Ceramics for Gas Turbines", Tibor Bornemisza, p. 659–670, Nov., 1996.
"Proceedings of the Advanced Turbine Systems Annual Program Review Meeting", "Status of Ceramic Gas Turbines in Russia", Mark van Roode, p. 671, Nov., 1996.
"Status Report: The U.S. Department of Energy's Advanced Turbine systems Program", facsimile dated Nov. 7, 1996.
"Testing Program Results Validate GE's H Gas Turbine—High Efficiency, Low Cost of Electricity and Low Emissions", Roger Schonewald and Patrick Marolda, (no date available).
"Testing Program Results Validate GE's H Gas Turbine—High Efficiency, Low Cost of Electricity and Low Emissions", Slide Presentation—working draft, (no date available).
"The Next Step In H . . . For Low Cost Per kW–Hour Power Generation", LP–1 PGE '98.
"Utility Advanced Turbine System (ATS) Technology Readiness Testing and Pre–Commercialization Demonstration", Document #486040, Oct. 1–Dec. 31, 1996, Publication Date, Jun. 1, 1997, Report Nos: DOE/MC/31176–5628.
"Utility Advanced Turbine System (ATS) Technology Readiness Testing—Phase 3", Document #666274, Oct. 1, 1996–Sep. 30, 1997, Publication Date, Dec. 31, 1997, Report Nos: DOE/MC/31176–10.
"Utility Advanced Turbine System (ATS) Technology Readiness Testing and Pre–Commercial Demonstration, Phase 3", Document #486029, Oct. 1–Dec. 31, 1995, Publication Date, May 1, 1997, Report Nos: DOE/MC/31176–5340.
"Utility Advanced Turbine System (ATS) Technology Readiness Testing and Pre–Commercial Demonstration—Phase 3", Document #486132, Apr. 1–Jun. 30, 1976, Publication Date, Dec. 31, 1996, Report Nos: DOE/MC/31176–5660.
"Utility Advanced Turbine System (ATS) Technology Readiness Testing and Pre–Commercial Demonstration—Phase 3", Document #587906, Jul. 1–Sep. 30, 1995, Publication Date, Dec. 31, 1995, Report Nos: DOE/MC/31176–5339.
"Utility Advanced Turbine System (ATS) Technology Readiness Testing and Pre–Commercial Demonstration" Document #666277, Apr. 1–Jun. 30, 1997, Publication Date, Dec. 31, 1997, Report Nos: DOE/MC/31176–8.
"Utility Advanced Turbine System (ATS) Technology Readiness Testing and Pre–Commercialization Demonstration" Jan. 1–Mar. 31, 1996, DOE/MC/31176–5338.
"Utility Advanced Turbine System (ATS) Technology Readiness Testing: Phase 3R", Document #756552, Apr. 1–Jun. 30, 1999, Publication Date, Sep. 1, 1999, Report Nos: DE–FC21–95MC31176–23.
"Utility Advanced Turbine System (ATS) Technology Readiness Testing.", Document #656823, Jan. 1–Mar. 31, 1998, Publication Date, Aug. 1, 1998, Report Nos: DOE/MC/31176–17.
"Utility Advanced Turbine Systems (ATS) Technology Readiness Testing and Pre–Commercial Demonstration", Annual Technical Progress Report, Reporting Period: Jul. 1, 1995–Sep. 30, 1996.
"Utility Advanced Turbine Systems (ATS) Technology Readiness Testing", Phase 3R, Annual Technical Progress Report, Reporting Period: Oct. 1, 1997–Sep. 30, 1998.
"Utility Advanced Turbine Systems (ATS) Technology Readiness Testing", Document #750405, Oct. 1–Dec. 30, 1998, Publication Date: May, 1, 1999, Report Nos: DE–FC21–95MC31176–20.
"Utility Advanced Turbine Systems (ATS) Technology Readiness Testing", Document #1348, Apr. 1–Jun. 29, 1998, Publication Date Oct. 29, 1998, Report Nos: DE–FC21–95MC31176–18.
"Utility Advanced Turbine Systems (ATS) Technology Readiness Testing—Phase 3", Annual Technical Progress Report, Reporting Period: Oct. 1, 1996–Sep. 30, 1997.
"Utility Advanced Turbine Systems (ATS) Technolog Readiness Testing and Pre–Commercial Demonstration", Quarterly Report, Jan. 1–Mar. 31, 1997, Document #666275, Report Nos: DOE/MC/31176–07.
"Proceedings of the 1997 Advanced Turbine Systems", Annual Program Review Meeing, Oct. 28–29, 1997.

* cited by examiner

Fig. 4
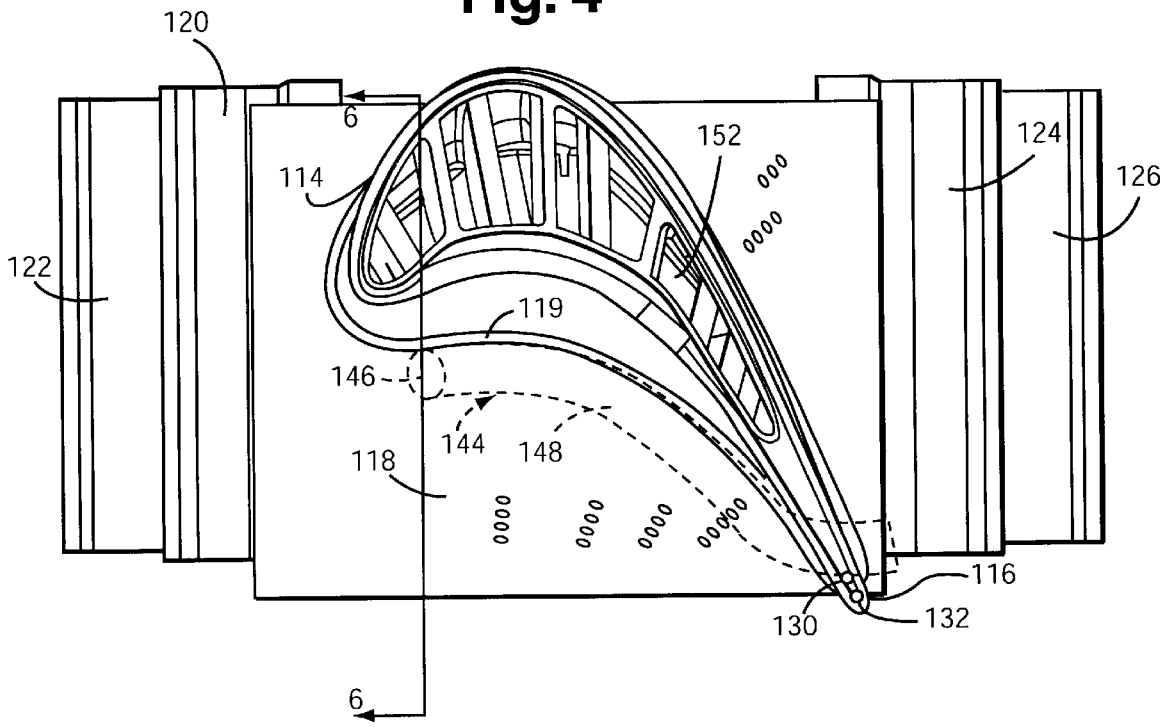
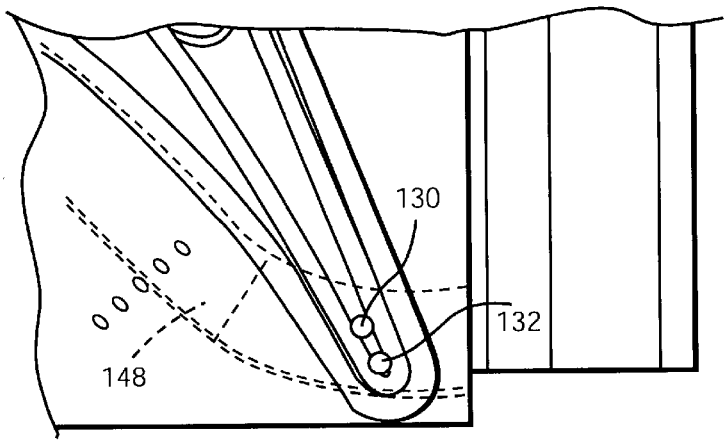
Fig. 5

GAS TURBINE BUCKET COOLING CIRCUIT AND RELATED PROCESS

This invention was made with Government support under Contract No. DE-FC21-95MC31176 awarded by the Department of Energy. The Government has certain rights in this invention.

BACKGROUND OF THE INVENTION

This invention relates to a closed loop, convection cooled gas turbine bucket and to a method for cooling the platform and airfoil fillet region of the bucket.

The technology of gas turbine bucket design is continually improving. Current state-of-the-art designs employ advanced closed loop cooling systems, higher firing temperatures and new materials to achieve higher thermal efficiency. Coincident with these advances, there is an ever increasing need to design components to avoid crack initiation and subsequent coolant loss due to low cycle fatigue.

Low cycle fatigue (LCF) is a failure mechanism common to all gas turbine buckets. It is defined as damage incurred by the cyclic reversed plastic flow of metal in a component exposed to fewer than 10,000 load cycles. Low cycle fatigue stress is a function of both the stress within the section as well as the temperature. The stress may come from mechanical loads such as pressure, gas bending, or centrifugal force, or the stress may be thermally induced, created by the difference in metal temperatures between various regions and the geometric constraints between these regions. Minimizing thermal gradients within a structure is key to reducing LCF damage.

In advanced gas turbine cooled bucket designs, particularly those with thermal barrier coatings, the airfoil bulk temperature tends to run cooler than the platform at the base of the airfoil, creating a thermal stress in the platform and airfoil fillet region on the pressure side of the airfoil (where the airfoil portion joins the platform). Adequate cooling of this region is necessary to reduce the stress and to improve the low cycle fatigue life.

During the production of the present bucket casting, the crossover core that generates the hollow cavity through which coolant is delivered to the machined trailing edge holes is locked into the shell system at the root of the bucket. The crossover core is also held by the shell at two mid-span locations (reference crossover core supports denoted in FIG. 1), and again at another location near the top of the crossover core.

It is critical to control the location of the top of the core since it is this location that forms a "target" for drilling the trailing edge cooling holes in the airfoil portion of the bucket. These machined trailing edge cooling holes must intersect the top of this core in order for coolant to flow through these holes and provide cooling to the airfoil trailing edge. One of the root causes of poor position control is inherent in the design. Specifically, since there is a difference in thermal expansion between the ceramic shell and ceramic core used in the casting process, and due to the relatively long length of the crossover core (approximately 12 inches) the crossover core is "pulled" by its root end where it is locked in the shell. Attempts to lock this design at the tip have failed due to the fragility of the core.

BRIEF SUMMARY OF THE INVENTION

This invention seeks to improve the low cycle fatigue capability of turbine buckets through use of an improved cooling system that is also more producible and cost effective. The design and manufacturing improvements are summarized below.

In terms of design, the crossover passage is opened to the cooling passage in the shank portion of the bucket at a location close to the underside of the platform, and then runs along the underside of the platform towards the trailing edge of the airfoil. This arrangement cools both the platform and the airfoil fillet region. For a second stage bucket, the flow direction can run from the aft portion of the bucket toward the leading edge where the flow enters a radially extending cooling passage in the airfoil portion of the bucket.

This design change means that the total height of the core used in the manufacture of the bucket can be shortened to reduce the amount of thermal mismatch. The redesigned crossover core can be locked in the shell at the forward or radially outer core end, thus eliminating the prior core end location problem. Since the crossover core will bump against the main body core, there is also no concern with respect to relative radial movement of the two cores. The crossover core will be allowed to float at the aft or radially inner core location. Since the core will be completely encapsulated by shell, however, and in close proximity to the platform, it is anticipated that relative movement between the core and the platform will be reduced, and thus dimensional control improved. A further benefit of this design will be lighter weight, chiefly due to the reduced size of the central rib in the shank portion of the bucket.

The design concept may also be implemented as a post cast fabrication rather than cast. In any event, the manufacturing process employed to produce the new bucket platform cooling circuit is not regarded as part of the invention per se.

The internal heat transfer coefficients of the new crossover passage design may be optimized either through tuning the cross sectional area or wetted perimeter, thus controlling flow velocity and heat transfer coefficient. Further, the passage may be locally turbulated to increase the local heat transfer coefficients without unnecessarily increasing pressure loss and heat pickup throughout the passage.

Alternative designs within the scope of the invention permit the cooling of virtually any region of the platform by simply re-routing the crossover passage along the underside of the platform. It is also contemplated that cooling steam be metered into the trailing edge holes by the cooling holes themselves. In applications where there are no trailing edge holes to meter the cooling flow, the amount of flow that would bypass the main cooling circuit would be too great given the size limitations that would be placed on the minimum cross sectional area of the crossover passage in order to achieve adequate core producibility. Accordingly, for such applications, a separate means for metering the flow into the trailing edge holes is provided.

In its broader aspects, therefore, the present invention relates to a closed circuit steam cooling arrangement in a gas turbine bucket having an airfoil portion joined to a platform along a fillet region and where a steam cooling supply passage is adapted to supply cooling steam to the airfoil portion of the bucket, and which also includes a crossover passage extending adjacent and substantially parallel to the platform.

In another aspect, the invention relates to a turbine bucket comprising an airfoil portion having leading and trailing edges; at least one radially extending cooling passage within the airfoil portion, the airfoil portion joined to a platform at a radially inner end of the airfoil portion; a dovetail mounting portion enclosing a cooling medium supply passage;

and, a crossover passage in fluid communication with the cooling medium supply passage and with at least one radially extending cooling passage, the crossover passage having a portion extending along and substantially parallel to an underside surface of the platform.

BRIEF DESCRIPTION OF THE DRAWINGS

FIG. 4 is a plan view of a gas turbine bucket in accordance with the invention, with the airfoil tip cap removed;

FIG. 5 is a partial section of the gas turbine bucket shown in FIG. 4, taken at a location in radial proximity to the bucket platform;

DETAILED DESCRIPTION OF THE INVENTION

Figure 1:
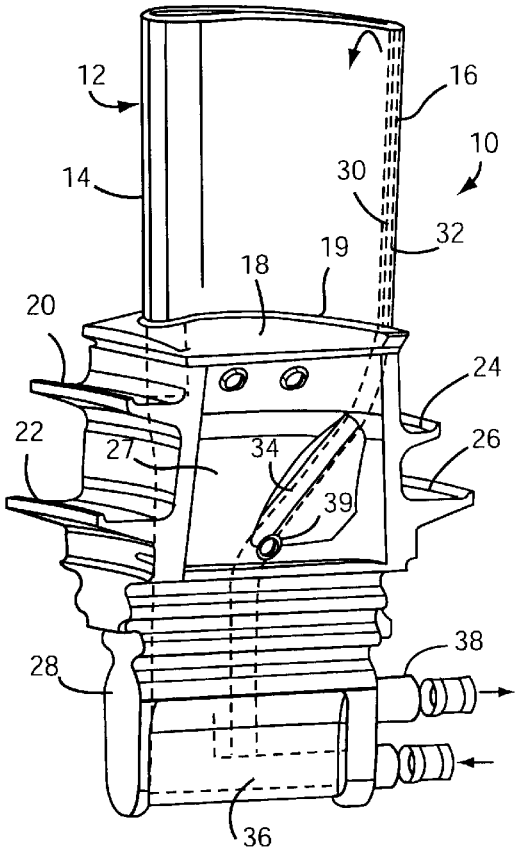
FIG. 1 is a partially cut away perspective view of a prior gas turbine bucket.

FIG. 1 illustrates a prior bucket trailing edge cooling circuit, which is part of a closed loop, serpentine circuit extending radially within the bucket. Only part of the bucket cooling circuit is shown. The bucket 10 includes an airfoil 12 having a leading edge 14 and a trailing edge 16. The airfoil is joined to a horizontal platform 18 along an airfoil fillet 19. So called "angel wings" 20, 22 and 24, 26 extend laterally away from the respective front and rear sides of the shank portion 27 of the bucket, and a dovetail portion 28 is employed to mount the bucket on a turbine wheel (not shown) in a conventional manner.

Trailing edge cooling holes 30, 32 (see also FIG. 2) extend internally along and adjacent the trailing edge 14 of the airfoil, while an internal crossover passage 34 extends from the lower end of holes 30, 32 to a coolant supply passage 36 in the dovetail portion of the bucket. Cooling steam (or other medium) will flow via passages 36 and 34 into the trailing edge cooling holes 30, 32. The cooling steam reverses direction (indicated by a flow arrow at the tip of the airfoil) and travels radially inwardly via a passage (not shown) flowing eventually into the cooling steam return passage 38.

Figure 2:
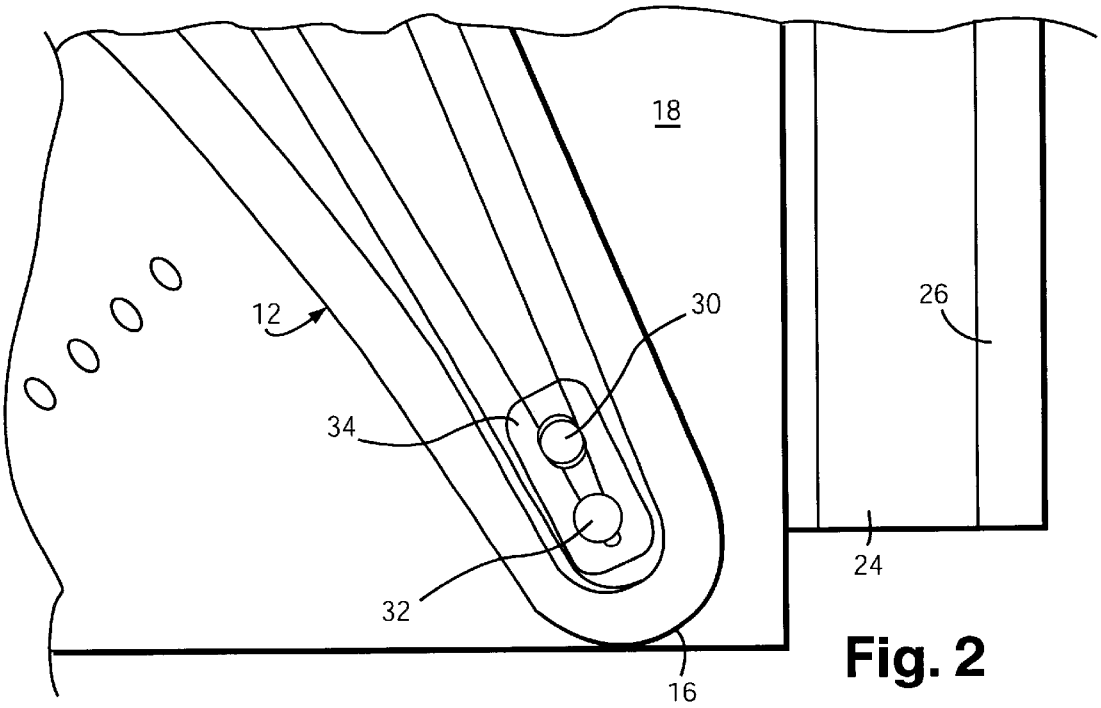
FIG. 2 is a partial plan view of the bucket shown in FIG. 1.

It is apparent from FIG. 2 that it is critical to control the location of the top of the core that forms the passage 34 during manufacture, since the trailing edge cooling holes 30, 32. Note also the relatively large distance between the top of the passage 34 and the location of a core support plug 39, a fact which makes accurate location of the top of the crossover core problematic.

Turning now to FIGS. 3–8, the manner in which the present invention alleviates these problems will now be discussed in detail.

Figure 3:
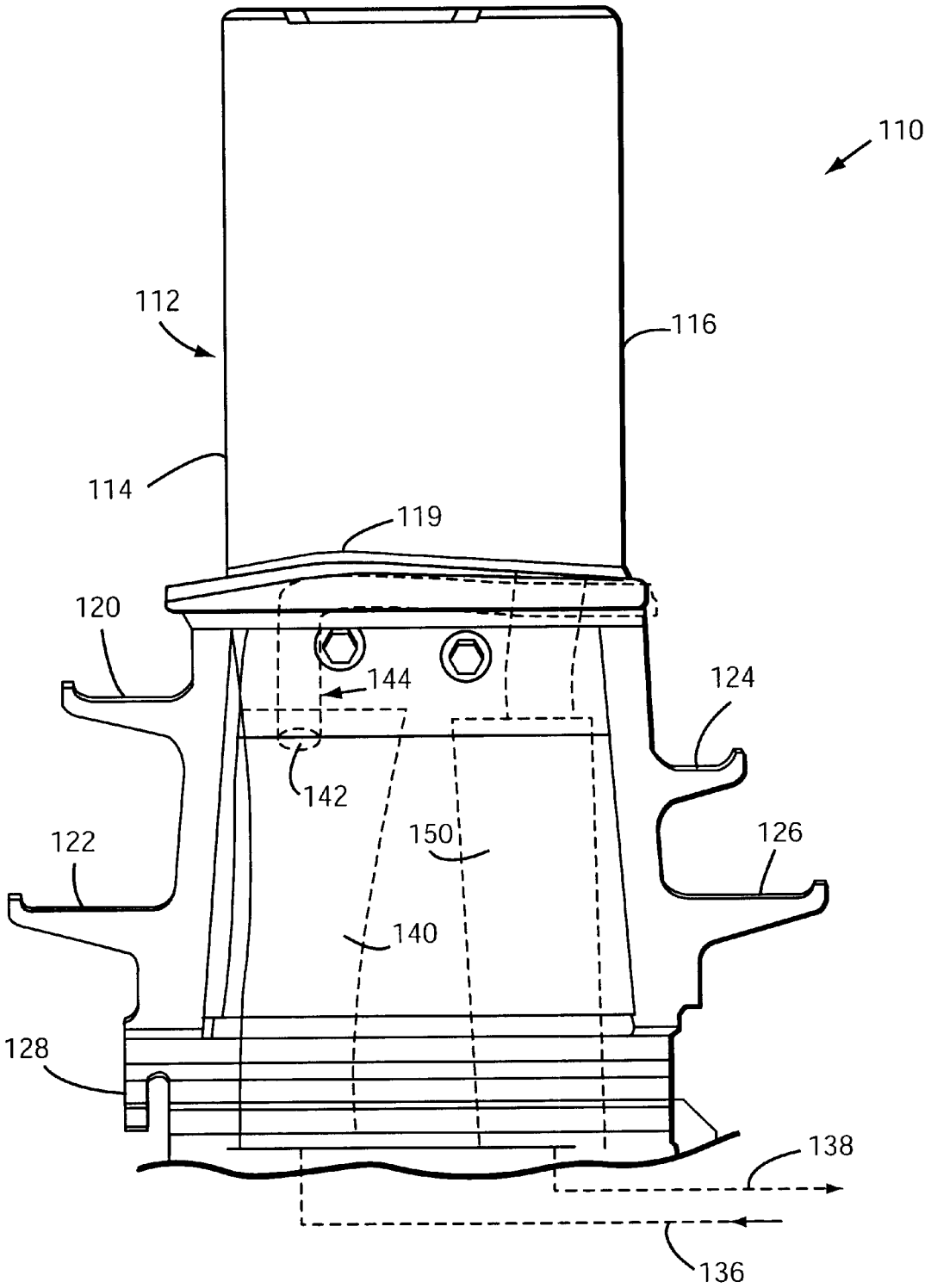
FIG. 3 is a partial side elevation of a gas turbine bucket in accordance with this invention, illustrating part of an internal cooling circuit.

In FIGS. 3 and 4, similar reference numerals are employed to indicate components corresponding to those in FIGS. 1 and 2, but with the prefix "1" added. Thus, the bucket 110 includes an airfoil 112 having a leading edge 114 and a trailing edge 116. The airfoil joins the platform 118 along an airfoil fillet 119. The bucket 110 also has angel wings 120, 122 and 124, 126 as well as dovetail portion 128. Radially extending trailing edge cooling passages, in the form of drilled holes 130, 132 extend internally along and adjacent the trailing edge 116. In this construction, however, the cooling supply passage 136 (see FIG. 6) supplies cooling steam to an enlarged interior chamber 140 which extends radially outwardly to a location generally adjacent the angel wing 120. A new crossover inlet 142 extends horizontally between the chamber 140 and a new crossover cooling passage 144 which has a radial (or vertical, as viewed in FIGS. 3 and 6) leg 146 and a horizontal leg 148 which extends along the underside of the platform 118 from the forward or leading side of the bucket to the rearward or trailing side of the bucket (as best seen in FIGS. 5) where the passage intersects the trailing edge cooling holes 130, 132. The cooling steam flows radially outwardly along the trailing edge and then reverses direction, flowing radially inwardly, dumping into chamber 150 which, in turn, connects to the cooling return passage 138. Note that some of the radial passages for the internal bucket cooling circuit are shown in FIG. 4, one such passage indicated at 152. In FIG. 5, it can be seen how the new core will provide a better target for the drilled trailing edge cooling holes 130, 132.

In FIGS. 3–6, it is apparent how the crossover passage 144 follows the contour of the pressure side of the airfoil, along the fillet 119, thereby providing needed cooling along the underside of the platform 118 as well as along fillet 119. It is also readily apparent from FIG. 2 that the height of the crossover passage is considerably reduced as compared to the prior arrangement. Crossover passage 144 may be turbulated as shown at 145 in FIG. 4.

Figure 6:
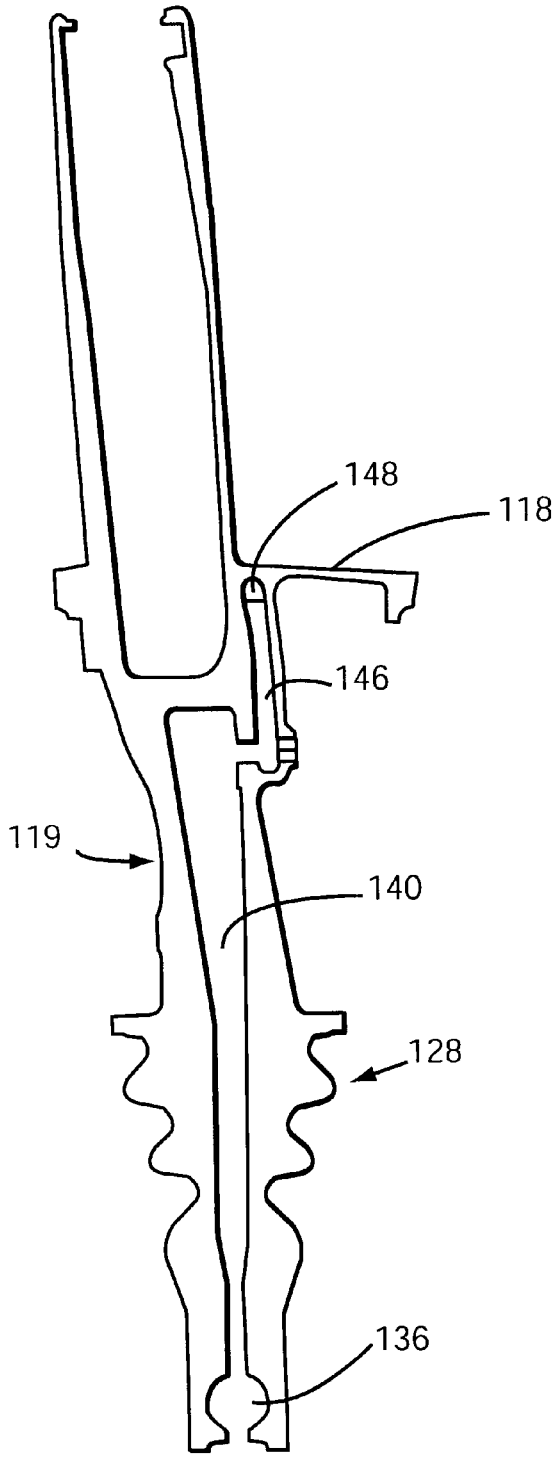
FIG. 6 is a cross section of the gas turbine bucket shown in FIG. 4, taken along the line 6—6.

FIG. 6 also illustrates the manner in which the airfoil is drilled through the main body so as to connect the passage 146 with the inlet 142 leading to the interior chamber 140. The hole is then plugged at 154.

Figure 7:
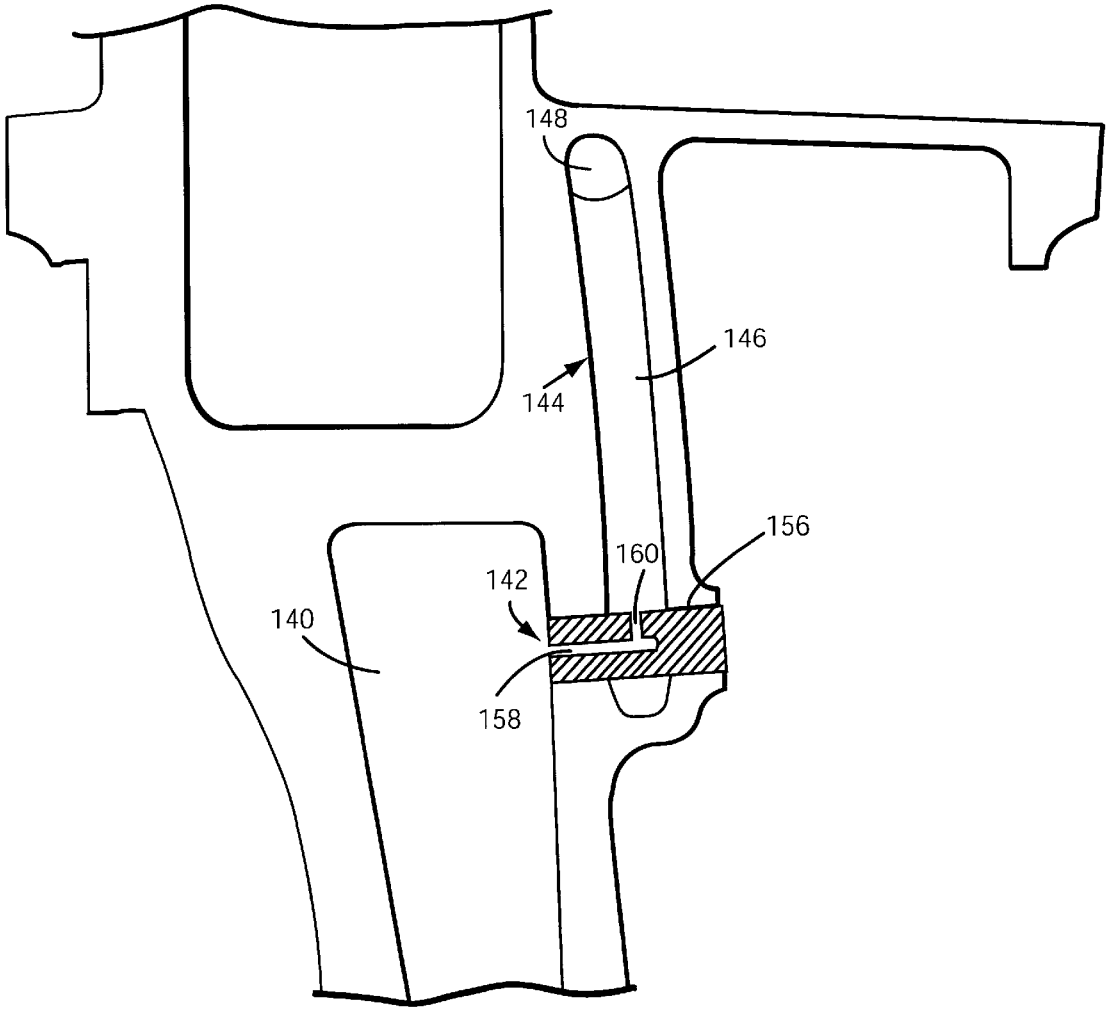
FIG. 7 is an enlarged detail taken from FIG. 6, but with a modified metering plug.

FIG. 7 illustrates an alternative arrangement where a plug 156 is inserted into the drilled hole providing the communication between chamber 140 and passage 146 via inlet 142. Here, the plug 156 is formed with metering holes 158 and 160 which meter air from the chamber 140 into the passage 146. This arrangement is particularly suitable where there are no trailing edge holes to meter the flow as, for example, in second stage buckets where the cooling flow is toward the leading edge of the bucket, and then in a radially extending passage in the airfoil portion of the bucket. It will be understood that the manner in which the crossover passage are formed and the manner in which access is provided to form interior passages for metering is dependent upon the manufacturing process used to produce the bucket. Where no separate metering mechanism is provided, the trailing edge holes 130, 132 are sized to meter the cooling air.

Figure 8:
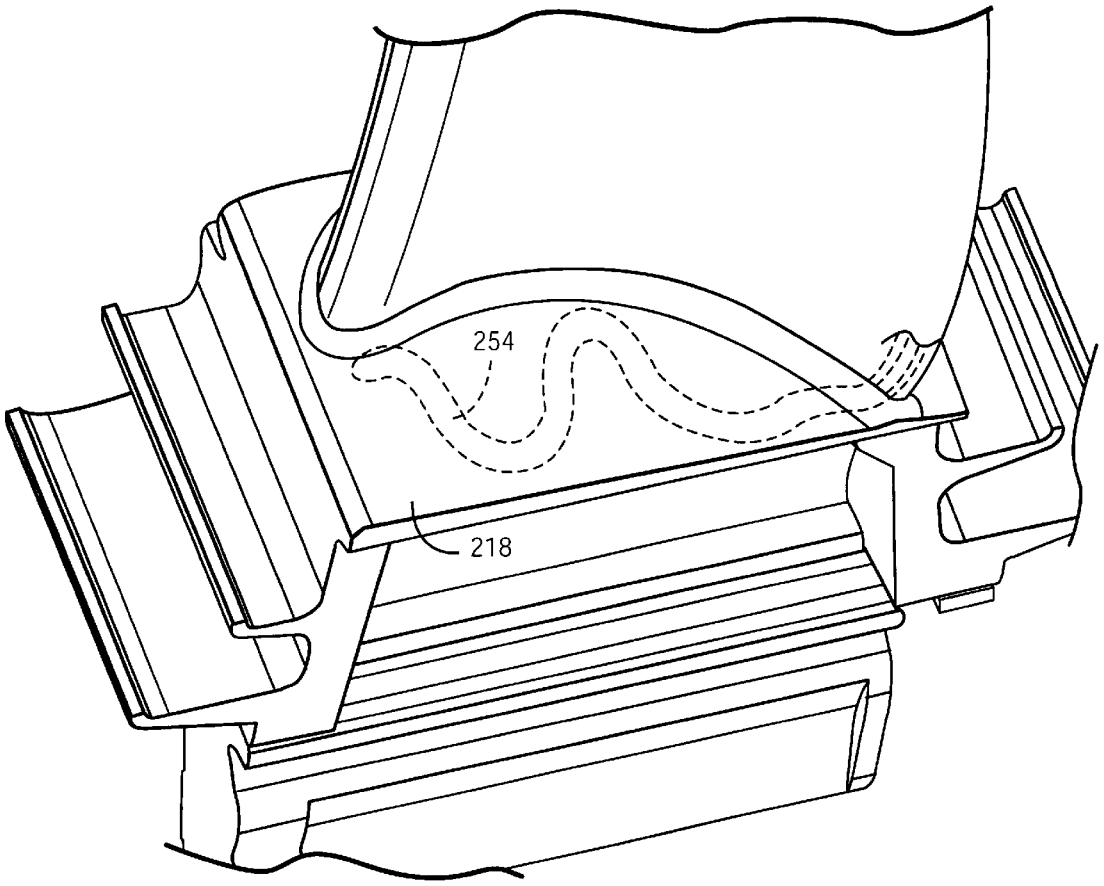
FIG. 8 is a partial perspective view of an alternative embodiment of the invention.

FIG. 8 discloses an alternative crossover passage 254 which is of serpentine configuration, permitting more of the platform 218 to be cooled. It will be appreciated that various design configurations can be implemented to cool the platform and/or fillet region as desired.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a closed circuit steam cooling arrangement in a gas turbine bucket having an airfoil portion with leading and trailing edges, joined to a platform along a fillet region and where a steam cooling supply passage is adapted to supply cooling steam to the airfoil portion of the bucket, a crossover cooling passage adjacent and substantially parallel to an underside of said platform, arranged to steam cool said platform and the fillet region along a pressure side of the bucket.

2. The closed circuit cooling arrangement of claim 1 wherein said airfoil portion includes at least one trailing edge cooling hole extending radially along said trailing edge and communicating with said crossover passage.

3. The closed circuit cooling arrangement of claim 2 wherein said at least one trailing edge cooling hole intersects said portion of said crossover passage at a substantially 90° angle.

4. In a closed circuit steam cooling arrangement in a gas turbine bucket having an airfoil portion with leading and trailing edges, joined to a platform along a fillet region and where a steam cooling supply passage is adapted to supply cooling steam to the airfoil portion of the bucket, a crossover cooling passage adjacent and substantially parallel to an underside of said platform, arranged to steam cool said platform and the fillet region along a pressure side of the bucket; and wherein said crossover passage includes one or more turbulators.

5. In a closed circuit steam cooling arrangement in a gas turbine bucket having an airfoil portion joined to a platform along a fillet region and where a steam cooling supply passage is adapted to supply cooling steam to the airfoil portion of the bucket, a crossover passage adjacent and substantially parallel to said platform, and including means for metering coolant flow into said crossover passage.

6. In a closed circuit steam cooling arrangement in a gas turbine bucket having an airfoil portion joined to a platform along a fillet region and where a steam cooling supply passage is adapted to supply cooling steam to the airfoil portion of the bucket, a crossover passage adjacent and substantially parallel to said platform, wherein said crossover passage follows a contour of a pressure side of said airfoil portion along the fillet region.

7. In a closed circuit steam cooling arrangement in a gas turbine bucket having an airfoil portion with leading and trailing edges, joined to a platform along a fillet region and where a steam cooling supply passage is adapted to supply cooling steam to the airfoil portion of the bucket, a crossover cooling passage adjacent and substantially parallel to an underside of said platform, arranged to steam cool said platform and the fillet region along a pressure side of the bucket; and wherein said crossover passage is formed with a serpentine path within said platform.

8. The closed circuit cooling arrangement of claim 1 wherein said crossover passage has a radial leg and a horizontal leg.

9. A turbine bucket comprising an airfoil portion having leading and trailing edges; at least one radially extending cooling passage within the airfoil portion, the airfoil portion joined to a platform at a radially inner end of the airfoil portion; a dovetail mounting portion enclosing a cooling medium supply passage; and, a crossover passage in fluid communication with said cooling medium supply passage and with said at least one radially extending cooling passage, said crossover passage having a portion extending along and substantially parallel to an underside surface of said platform, and arranged to steam cool said platform where said platform joins with said airfoil portion along a pressure side of the bucket.

10. A turbine bucket comprising an airfoil portion having leading and trailing edges; at least one radially extending cooling passage within the airfoil portion, the airfoil portion joined to a platform at a radially inner end of the airfoil portion; a dovetail mounting portion enclosing a cooling medium supply passage; and, a crossover passage in fluid communication with said cooling medium supply passage and with said at least one radially extending cooling passage, said crossover passage having a portion extending along and substantially parallel to an underside surface of said platform, and arranged to steam cool said platform where said platform joins with said airfoil portion alone a pressure side of the bucket; and wherein said crossover passage includes one or more turbulators.

11. A turbine bucket comprising an airfoil portion having leading and trailing edges; at least one radially extending cooling passage within the airfoil portion, the airfoil portion joined to a platform at a radially inner end of the airfoil portion; a dovetail mounting portion enclosing a cooling medium supply passage; and, a crossover passage in fluid communication with said cooling medium supply passage and with said. at least one radially extending cooling passage, said crossover passage having a portion extending along and substantially parallel to an underside surface of said platform, and including means for metering coolant flow into said crossover passage.

12. A turbine bucket comprising an airfoil portion having leading and trailing edges; at least one radially extending cooling passage within the airfoil portion, the airfoil portion joined to a platform at a radially inner end of the airfoil portion; a dovetail mounting portion enclosing a cooling medium supply passage; and, a crossover passage in fluid communication with said cooling medium supply passage and with said at least one radially extending cooling passage, said crossover passage having a portion extending along and substantially parallel to an underside surface of said platform, wherein said crossover passage follows a contour of a pressure side of said airfoil portion along a fillet region.

13. A method of cooling a turbine bucket platform in a turbine bucket having an airfoil portion joined to the platform and an internal steam cooling circuit that includes at least one radially extending steam cooling passage, the method comprising:

a) providing a steam coolant supply passage in a dovetail mounting portion of the bucket;

b) providing a crossover passage connecting said steam coolant supply passage and said at least one radially extending steam cooling passage; and c) arranging said crossover passage to extend along and substantially parallel to an underside of said platform at least in a fillet area where the airfoil portion is joined to the platform to thereby steam cool at least said fillet area.

14. A method of cooling a turbine bucket platform in a turbine bucket having an internal cooling circuit that includes at least one radially extending cooling passage, the method comprising:

a) providing a coolant supply passage in a dovetail mounting portion of the bucket;

b) providing a crossover passage connecting said coolant supply passage and said at least one radially extending cooling passage; and c) arranging said crossover passage to extend along and substantially parallel to an underside of said platform in an area to be cooled, wherein said crossover passage follows a contour of a pressure side of said airfoil portion.

15. A method of cooling a turbine bucket platform in a turbine bucket having a airfoil portion joined to the platform and an internal steam cooling circuit that includes at least one radially extending steam cooling passage, the method comprising:

a) providing a steam coolant supply passage in a dovetail mounting portion of the bucket;

b) providing a crossover passage formed with a serpentine path within said platform, connecting said steam coolant supply passage and said at least one radially extending steam cooling passage; and c) arranging said crossover passage to extend along and substantially parallel to an underside of said platform at least in a fillet area where the airfoil portion is joined to the platform to thereby cool at least said fillet area.

* * * * *